US010941560B2

(12) United States Patent
DiTrolio

(10) Patent No.: US 10,941,560 B2
(45) Date of Patent: Mar. 9, 2021

(54) CONNECTOR FOR PIPES

(71) Applicant: Philip DiTrolio, Suwanee, GA (US)

(72) Inventor: Philip DiTrolio, Suwanee, GA (US)

( * ) Notice: Subject to any disclaimer, the term of this patent is extended or adjusted under 35 U.S.C. 154(b) by 596 days.

(21) Appl. No.: 15/727,695

(22) Filed: Oct. 9, 2017

(65) Prior Publication Data

US 2018/0119410 A1 May 3, 2018

Related U.S. Application Data

(60) Provisional application No. 62/417,121, filed on Nov. 3, 2016.

(51) Int. Cl.

| | |
|---|---|
| ***E04B 1/24*** | (2006.01) |
| ***E04H 1/12*** | (2006.01) |
| ***A47H 1/02*** | (2006.01) |
| ***A47H 1/102*** | (2006.01) |

(52) U.S. Cl.

CPC ..... *E04B 1/2403* (2013.01); *A47H 1/02* (2013.01); *A47H 1/102* (2013.01); *E04H 1/1272* (2013.01); *E04B 2001/2409* (2013.01)

(58) Field of Classification Search

CPC .. A47H 1/02; A47H 1/102; E04B 2001/2406; E04B 2001/2409; E04B 2001/2421; E04B 2/2403; E04B 2002/0236; Y10T 403/34; E04H 1/1272; F16B 2200/30

See application file for complete search history.

(56) References Cited

U.S. PATENT DOCUMENTS

| | | | | | |
|---|---|---|---|---|---|
| 409,893 | A * | 8/1889 | Wray | F16G 11/10 | 403/182 |
| 4,019,298 | A * | 4/1977 | Johnson, IV | E04B 1/185 | 52/590.1 |
| 4,261,138 | A * | 4/1981 | St. George Syms | A47G 33/12 | 248/523 |
| 4,723,384 | A * | 2/1988 | Mengeringhausen | E04B 1/24 | 52/126.1 |
| 4,867,598 | A * | 9/1989 | Winter, IV | E04B 2/08 | 403/381 |
| 4,951,438 | A * | 8/1990 | Thoresen | E04B 1/215 | 403/187 |
| 5,111,631 | A * | 5/1992 | Flood | A47F 5/14 | 52/646 |
| 5,289,665 | A * | 3/1994 | Higgins | E04B 1/2403 | 211/191 |
| 5,291,708 | A * | 3/1994 | Johnson | E02D 27/01 | 52/282.2 |
| 5,433,416 | A * | 7/1995 | Johnson | B65D 23/003 | 248/475.1 |
| 5,680,737 | A * | 10/1997 | Sheipline | E04B 1/24 | 403/169 |
| 5,911,762 | A * | 6/1999 | Ott | A47F 3/002 | 211/26.1 |

(Continued)

*Primary Examiner* — Matthew R McMahon

(74) *Attorney, Agent, or Firm* — Johnson, Marcou, Isaacs & Nix, LLC

(57) ABSTRACT

A connector for a pipe and drape exhibit system enables the universal attachment of drape rods to the tops of support pipes using a coupler that mounts within the top of the pipes and extends upwardly to receive a connection hook carried by a drape rod within a taper slot such that the connection hook is received and retained behind a peripheral wall defining an open center of the connector.

14 Claims, 4 Drawing Sheets

(56) References Cited

U.S. PATENT DOCUMENTS

| | | | | |
|---|---|---|---|---|
| 6,837,016 | B2 * | 1/2005 | Simmons | E04B 1/2403 403/173 |
| 6,952,905 | B2 * | 10/2005 | Nickel | F16B 12/20 52/711 |
| 6,969,211 | B2 * | 11/2005 | Altman | E04B 1/5831 403/374.4 |
| 8,209,924 | B2 * | 7/2012 | Foley | E04B 1/4114 52/289 |
| 8,209,925 | B2 * | 7/2012 | Foley | E04B 1/4114 52/289 |
| 9,211,027 | B2 * | 12/2015 | Ovist | A47H 1/02 |
| 2006/0165482 | A1 * | 7/2006 | Olberding | E04B 1/24 403/381 |
| 2006/0278777 | A1 * | 12/2006 | Atkinson | A47B 13/021 248/188.4 |

* cited by examiner

CONNECTOR FOR PIPES

This application claims priority from U.S. provisional patent application No. 62/417,121 entitled Coupler for Pipes, filed Nov. 3, 2016 which incorporated herein by reference as fully as set forth herein.

FIELD OF INVENTION

The present invention relates to couplers for drape rods of the type typically found in exhibit booths. In even greater particularity the present invention relates to a universal coupler for coupling transverse drape rods to vertical support rods for creating exhibit booths. In still further particularity, the present invention relates to an insert adapted to be inserted into the upper end of a support post to facilitate coupling of transvers drape rods to the support post.

BACKGROUND

In the prior art, exhibit booths and the like are constructed using a tubular framework supporting drapes as walls and or covers. Many of these booths are constructed using a hook-and-slot systems which utilize upright aluminum poles with slots formed near the top regions thereof for receiving hooks secured to and extending from the ends of horizontally-positioned tubular rods. Draping material is placed over the horizontal rods to form booths or partitions as may be required. Pipe and drape walls traditionally have a "bumpy" appearance due to the height difference of the vertical members in relation to the top of horizontally disposed connecting rods. Additionally, the steel hooks on industry standard horizontal drape rods have a tendency toward "tearing" the aluminum vertical uprights in a "can opener" effect when the steel hooks are inserted in the existing slots in the uprights. Past attempts to solve these problems involve proprietary connectors that are not compatible with the standard steel hooks.

SUMMARY OF THE INVENTION

It is an object of the invention enable the industry standard hooks on the horizontal rods to rest at such a height as to provide uniform appearance to the top of drape walls. It is a further object to prevent the steel hooks on industry standard horizontal drape rods from "tearing" into the support pipes. Yet another object of the invention is to allow for the industry standard hooks to be inserted at a wider angle of insertion and easier connection than the narrow industry standard slots. A still further object of the invention is to accomplish the foregoing objects using with industry standard fasteners or hooks.

BRIEF DESCRIPTION OF THE DRAWINGS

Referring to the drawing which is appended hereto and which form a portion of this disclosure, it may be seen that.

DETAILED DESCRIPTION

Referring to the Figures for a clearer understanding of the invention, it may seem that one more of the above objects of the invention can be achieved, at least in part, by providing a coupler component 10 for connecting substantially orthogonally disposed rods to vertical support pipes in a pipe and drape exhibit booth construction. The "Pipe and Drape" industry is a subset of exhibition and convention services in which frameworks are constructed from horizontally and vertically disposed members in such a fashion to allow draperies or curtains to hang and create division of space in convention halls or other similar areas by arranging drapery walls and booths. The coupler 10 is designed to provide an improvement to form and function over the industry standard hook and slot technology, yet allow users of existing systems to continue using their inventory of components.

Figure 1:
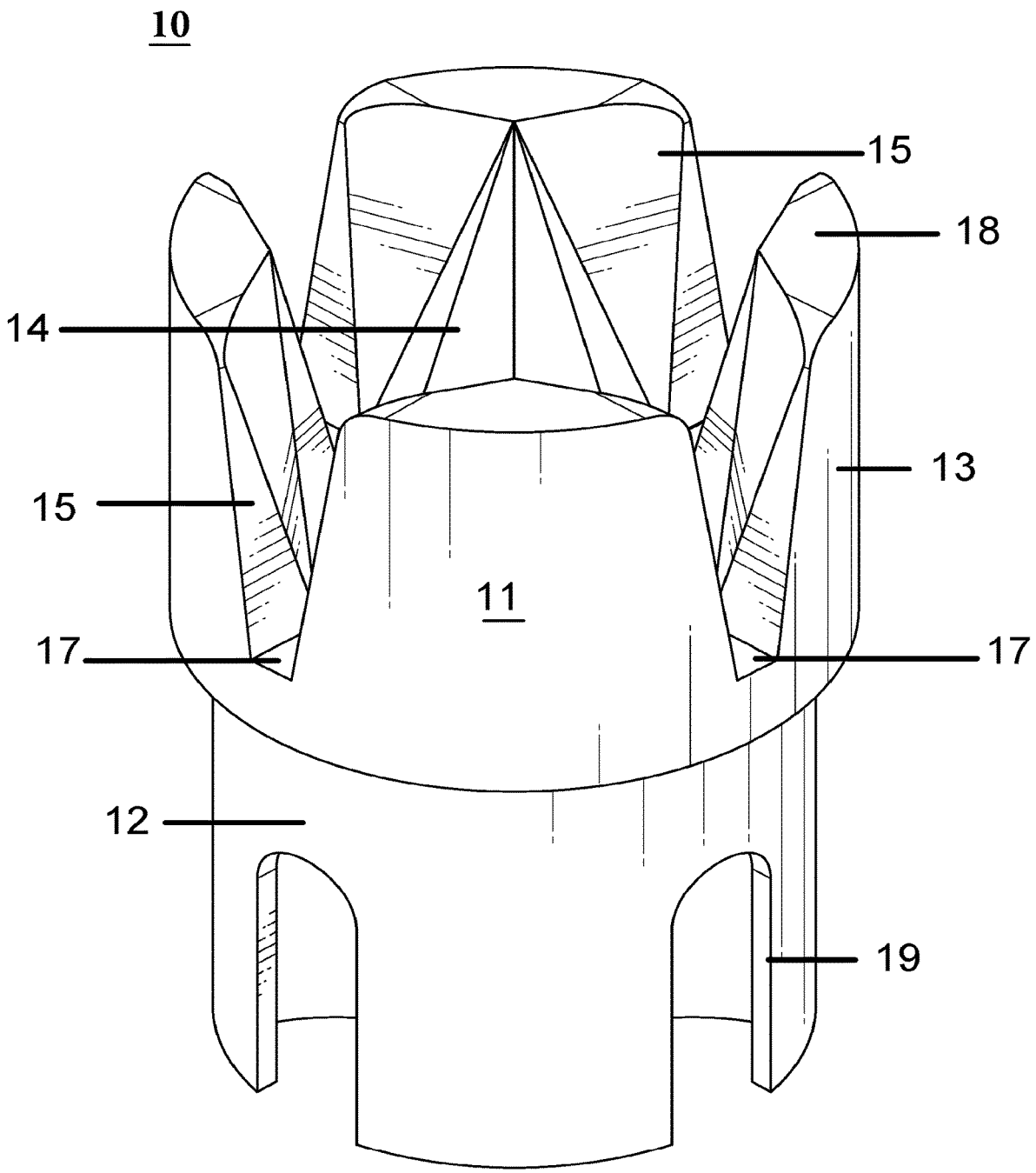
FIG. 1 is a perspective view of one embodiment of my invention.
Figure 2:
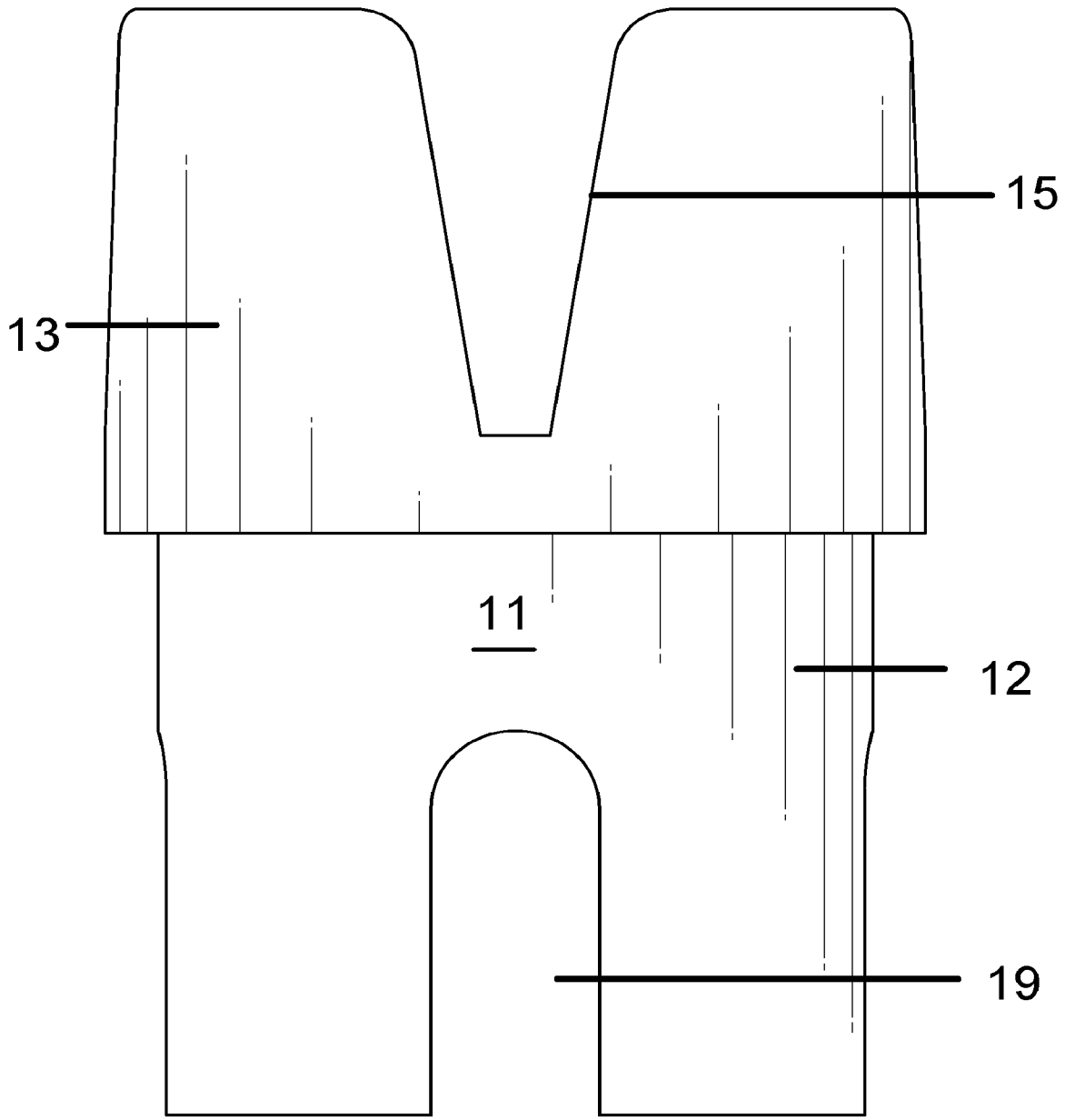
FIG. 2 is a side elevation of one embodiment of my invention.
Figure 3:
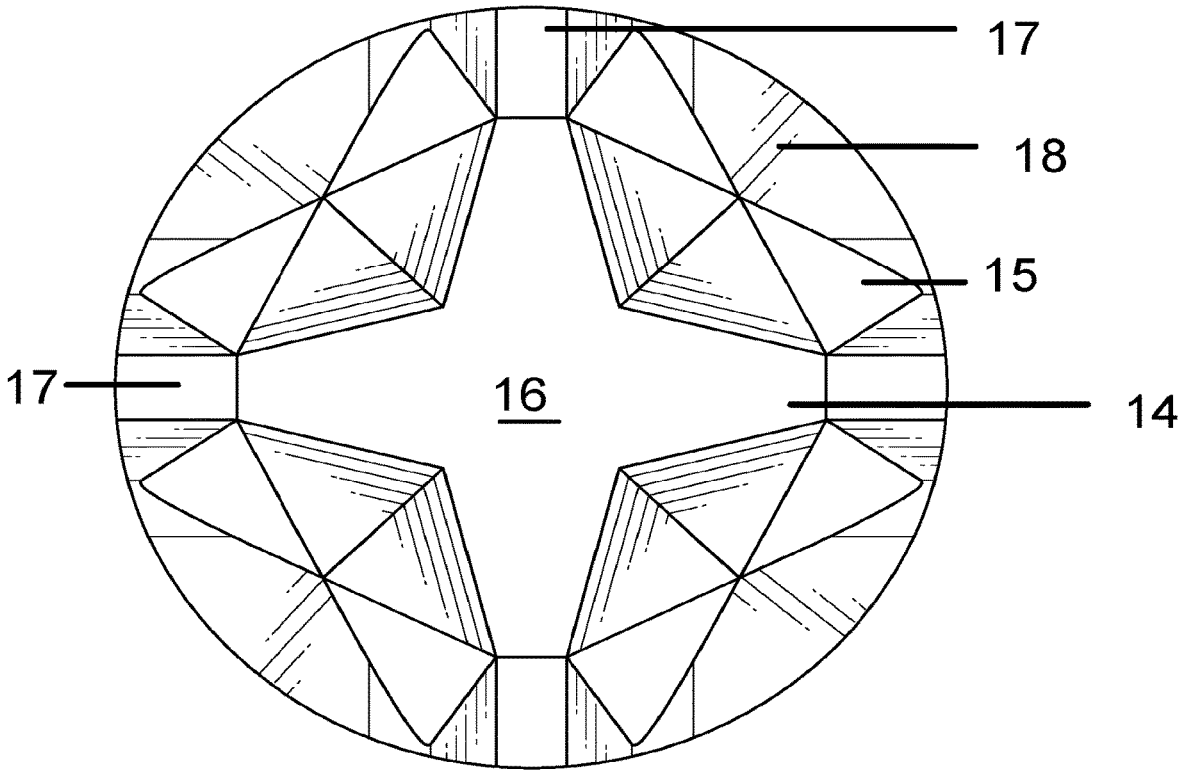
FIG. 3 is a top plan view of one embodiment of my invention.
Figure 4:
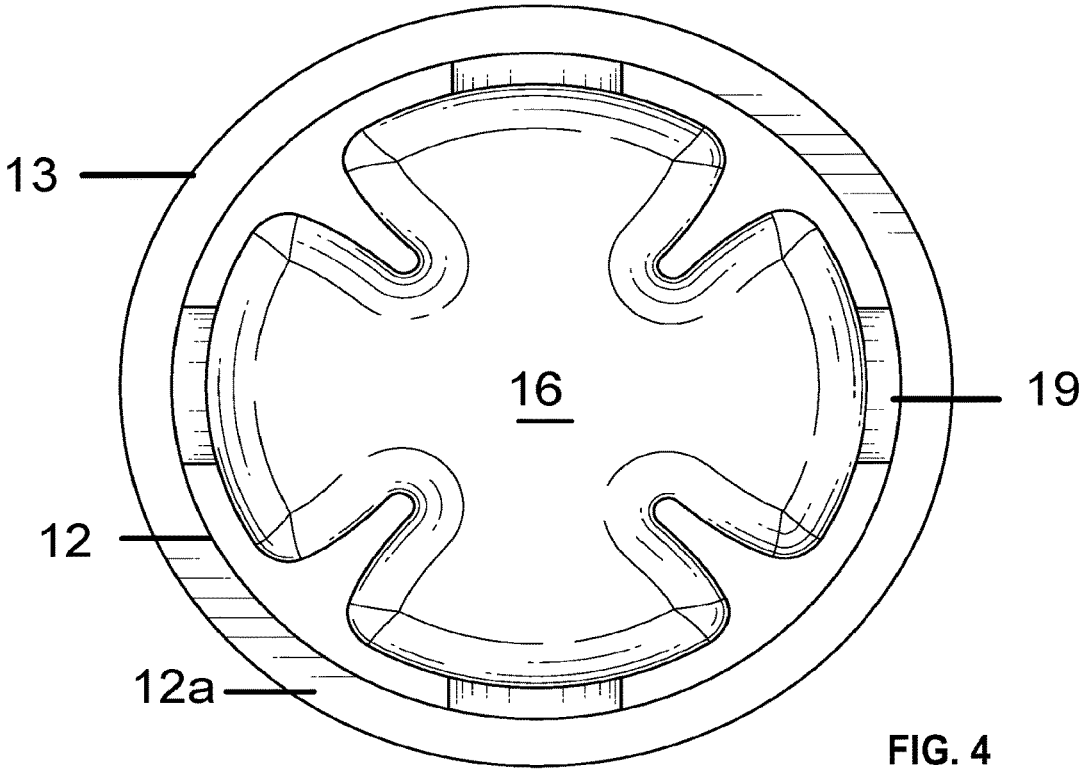
FIG. 4 is a bottom plan view of one embodiment of my invention.
Figure 5:
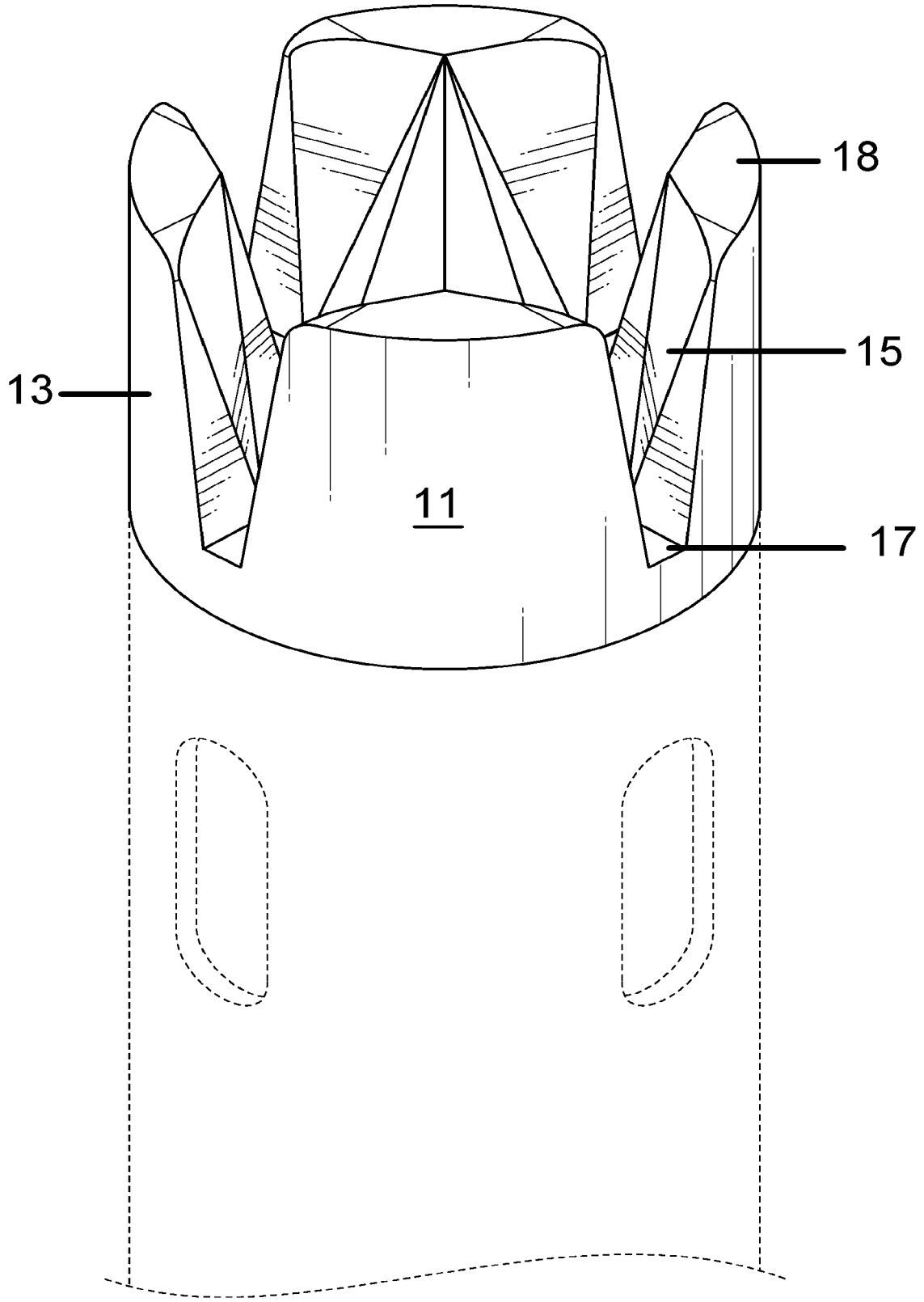
FIG. 5 is a perspective view of the embodiment shown in the above figures coupled to a support pipe shown in dotted line.

FIG. 1 provides a limited isometric view of the coupler 10 which is an end-cap component for vertical members used to construct the aforesaid pipe and drape booths. Because the standard pipe and rod construction is well known the vertical member is shown only in phantom in FIG. 5. Likewise, because the steel terminal hooks traditionally used on the transverse rods to connect to the vertical member are used to connect to the instant coupler 10, the steel hooks are not illustrated. Coupler 10 has a body 11 with a base region 12 of a smaller diameter than an upper region 13 which may be of a similar or greater outside dimension as the standard vertical support pipe. A generally horizontal shoulder 12*a* is formed at the junction of base region 12 and upper region 13, such that the base region 12 will fit inside the internal cavity at the top of the standard vertical support pipe. Internally of the coupler 10, at least one hollow well 14 opens vertically with at least one lateral notch or opening 15 formed in upper region 13 and designed to accept a terminal hook used on an end of the horizontally placed rod. It is to be understood that the coupler 10 may be hollow or may have a floor formed there within. Preferably, coupler 10 will be made from durable reinforced polymer material, ABS plastic, Delrin, polyurethane or some other suitable material that has sufficient strength had rigidity to effectuate the connection.

The opening 15 is preferably formed with a wider upper dimension and tapers to a narrower seat 17 at the bottom of opening 15. The seat 17 is positioned at a height above an internal floor 16, if present, of the hollow well 14 to allow industry standard terminal hooks to rest on the seat 17 within opening 15 and well 14 such that, when used as a rod and drape booth framework, the drapery walls have a uniform, flat appearance and the hooks are securely retained in the opening 15. Upper region 13 has a thickness at seat 17 to provide sufficient mass to engage and retain the horizontal rods.

The top surfaces 18 of the coupler 10 are preferably rounded but may be beveled or flat as is true of the tapering surfaces of opening 15. Note also that the upper region 13 need not be round, but can be square, octagonal, conic, or any shape.

The base region 12 may have downwardly opening slots 19 which align with the traditional slots formed in standard vertical members to allow the slots on industry standard poles to remain usable when the coupler component 10 is inserted into a standard support pipe. These slots 19 may have square, rounded or beveled edges and may include a web of material closing the lower end of the slot. The base region 12 may have a lattice or matrix structure to reduce raw material usage, reduce weight, and improve strength.

While in the foregoing specification this invention has been described in relation to certain embodiments thereof, and many details have been put forth for the purpose of illustration, it will be apparent to those skilled in the art that the invention is susceptible to additional embodiments and that certain of the details described herein can be varied considerably without departing from the basic principles of the invention.

I claim:

1. A coupler configured to couple to tubular members, including a vertical support pipe and at least one horizontally extending drape rod having a terminal connector, comprising a lower region sized to be received within a vertical support pipe and a second region having a greater transverse dimension than said lower region such that a shoulder is formed at the junction of said lower region and said second region, wherein an upwardly opening well is formed within said coupler, said second region defining at least one truncated V-shaped slot configured to receive a coupling hook, wherein each vertical side of the truncated V-shaped slot comprises flat surfaces facing toward a center of the truncated V-shaped slot, the flat surfaces being tapered such that the flat surfaces are wider at the bottom than at the top, and a horizontal, rectangular, upward facing seat of a bottom portion of the at least one truncated V shaped slot.

2. The coupler as defined in claim 1 wherein each of the at least one truncated V-shaped slot has an upper dimension greater than the dimension of said seat with said at least one truncated V-shaped slot diverging from said seat.

3. The coupler as defined in claim 1 wherein said lower region defines a plurality of orthogonally disposed downwardly opening slots.

4. The coupler as defined in claim 1 wherein said coupler is made of a polymer material.

5. The coupler as defined in claim 1, further comprising a floor forming a bottom of the upwardly opening well.

6. The coupler as defined in claim 5, wherein the floor of the upwardly opening well is configured to be positioned lower than a level of the horizontal upward facing seat of the bottom portion of the truncated V-shaped slot.

7. An insert configured to be affixed to a top of a support pipe, the insert having a lower region insertable within said pipe and an upper region having a transverse dimension configured to be greater than said pipe, said upper region including a circumferential wall having at least one truncated V-shaped slot configured to receive a coupling hook, wherein each vertical side of the truncated V-shaped slot comprises flat surfaces facing toward a center of the truncated V-shaped slot, the flat surfaces being tapered such that the flat surfaces are wider at the bottom than at the top, and a seat of the truncated V-shaped slot is a flat rectangle.

8. The insert as defined in claim 7 wherein said circumferential wall defines an upwardly opening well within said insert and said at least one truncated V shaped slot extends through said circumferential wall in communication with said upwardly opening well.

9. The insert as defined in claim 7 wherein said circumferential wall defines an open axial bore and said at least one truncated V shaped slot extends through said circumferential wall in communication with said axial bore.

10. The insert as defined in claim 7 wherein said insert is made from a material selected from the group consisting of reinforced polymer material, ABS plastic, Delrin, and polyurethane.

11. The insert as defined in claim 7 wherein said lower region defines a plurality of orthogonally disposed downwardly opening slots.

12. A coupler configured to connect at least one vertical support pipe to at least one horizontally disposed drape rod having a terminal connector, comprising:

a. a body having a lower region and an upper region, said lower region having a dimension suitable for insertion into an upper end of said vertical support pipe, said upper region have a transverse dimension configured to be greater than said upper end of said vertical support pipe such that a shoulder is formed on said body intermediate said upper region and said lower region, said body including a peripheral wall including at least said upper region;

b. a plurality of upwardly opening V-shaped slots formed in said peripheral wall, each of said plurality of upwardly opening V-shaped slots tapering from a narrower upper dimension to a wider lower dimension defining a seat in each of said plurality of slots, and the seat in each of said plurality of slots is a horizontal, upwardly facing, flat rectangle, such that a portion of said terminal connector may be retained within said peripheral wall while the terminal connector extends through one of said plurality of slots while supported by said seat.

13. A coupler as defined in claim 12 wherein said coupler is made from a material selected from the group consisting of reinforced polymer material, ABS plastic, delrin, and polyurethane.

14. The coupler as defined in claim 13 wherein said peripheral wall surrounds an upwardly opening well within said body such that said portion of said terminal connector is retained within said upwardly opening well.

* * * * *